US006115576A

United States Patent [19]

Nakano et al.

[11] Patent Number: 6,115,576

[45] Date of Patent: Sep. 5, 2000

[54] IMAGE FORMING APPARATUS USING A DEVELOPING LIQUID AND INCLUDING AN INTERMEDIATE TRANSFER BODY

[75] Inventors: Tohru Nakano; Sadayuki Iwai; Hideki Kosugi; Yusuke Takeda, all of Kanagawa, Japan

[73] Assignee: Ricoh Company, Ltd., Tokyo, Japan

[21] Appl. No.: 09/301,723

[22] Filed: Apr. 29, 1999

[30] Foreign Application Priority Data

May 1, 1998 [JP] Japan ..... 10-137446
May 26, 1998 [JP] Japan ..... 10-162918

[51] Int. Cl.[7] ..... G03G 15/16; G03G 15/01; G03G 15/10

[52] U.S. Cl. ..... 399/302; 399/233; 399/237; 399/296; 399/308

[58] Field of Search ..... 399/302, 308, 399/307, 296, 313, 314, 237, 48, 359, 233; 427/487

[56] References Cited

U.S. PATENT DOCUMENTS 5,189,478 2/1993 Hara et al. ..... 399/302 X
5,438,398 8/1995 Tanigawa et al. ..... 399/302
5,512,986 4/1996 Toyomura et al. ..... 399/308 X
5,619,316 4/1997 Shoji et al. ..... 399/359
5,666,589 9/1997 Yoshinaga et al. ..... 399/48
5,666,616 9/1997 Yoshino et al. .
5,708,938 1/1998 Takeuchi et al. .
5,708,950 1/1998 Badesha et al. ..... 399/307 X
5,753,317 5/1998 Law et al. ..... 427/487
5,765,084 6/1998 Asada et al. ..... 399/233 X
5,826,147 10/1998 Liu et al. ..... 399/296 X
5,950,058 9/1999 Kusaba et al. ..... 399/302
5,991,567 11/1999 Kobayashi et al. ..... 399/302 X
5,999,763 12/1999 Hiroshima et al. ..... 399/302 X

*Primary Examiner*—Susan S. Y. Lee
*Attorney, Agent, or Firm*—Oblon, Spivak, McClelland, Maier & Neustadt, P.C.

[57] ABSTRACT

In an image forming apparatus, a developing device develops an electrostatic latent image formed on an image carrier with a developing liquid to thereby produce a corresponding toner image. The toner image is transferred from the image carrier to an intermediate transfer body. To increase a transfer ratio from the intermediate transfer body to a paper or similar recording medium, charge applying device applies to the toner image transferred to the intermediate transfer member a charge identical in polarity with toner particles forming the toner image. A roller member faces the surface of the intermediate transfer body to which the toner image is transferred for cleaning the transfer body and removing a carrier liquid. The roller member also controls the amount of carrier liquid on the intermediate transfer body.

6 Claims, 9 Drawing Sheets

IMAGE FORMING APPARATUS USING A DEVELOPING LIQUID AND INCLUDING AN INTERMEDIATE TRANSFER BODY

BACKGROUND OF THE INVENTION

The present invention relates to a copier, printer, facsimile apparatus or similar image forming apparatus and more particularly to an image forming apparatus including a developing device using a developing liquid and an intermediate transfer body.

An image forming apparatus of the type including a developing device using a developing liquid is conventional. The developing liquid is a mixture of toner particles and a carrier liquid. The developing device develops an electrostatic latent image formed on an image carrier with the developing liquid to thereby produce a corresponding toner image. The toner image is transferred from the image carrier to a paper or similar recording medium. To deposit the toner particles on the image carrier at the time of development and to transfer them from the image carrier to the paper at the time of image transfer, the above apparatus uses the electophoresis of the toner particles charged by the carrier liquid.

An image forming apparatus of the type using an intermediate transfer body is also conventional. This type of image forming apparatus transfers toner images sequentially formed on an image carrier to the intermediate transfer body one above the other (primary transfer) and then transfers the resulting composite toner image to a paper (secondary transfer). The intermediate transfer body has customarily been used in a color image forming apparatus, which forms a color image on a paper.

The following problem arises when the intermediate transfer body is applied to the color image forming apparatus including the developing device using the developing liquid. When toner images of different colors (e.g. four colors) are transferred from the image carrier to the intermediate transfer body one above the other, the secondary transfer ratio from the transfer body to a paper decreases.

We conducted a series of researches and experiments for solving the above problem and found the following. Every time a toner image of one color is transferred from the image carrier to the intermediate transfer body, the solid matter content of the developer deposited on the transfer body increases. As a result, the apparent amount of charge of the dense group of toner particles becomes smaller than the sum of the charges, which the toner particles individually had. Consequently, the charge to contribute to the electrophoresis for the secondary transfer decreases and obstructs the transfer of the toner particles to a paper.

The image forming apparatus with the above developing device and intermediate transfer body generally includes a cleaning device for cleaning the transfer body with a cleaning blade or similar cleaning member. The problem with the cleaning member is that when it is formed of rubber belonging to a family of elastic materials, the blade lacks in durability and cannot implement the expected cleaning ability.

Further, the carrier liquid on the intermediate transfer body would render image transfer insufficient if too small in amount or would cause the image to flow if too great in amount. Particularly, when four toner images of different colors are sequentially transferred from the image carrier to the intermediate transfer body, the amount of the carrier liquid on the transfer body tends to sequentially increase from the second color to the fourth color. It is therefore necessary to accurately control the amount of the carrier liquid on the intermediate transfer body.

SUMMARY OF THE INVENTION

It is therefore a first object of the present invention to provide an image forming apparatus of the type using a developing liquid and including an intermediate transfer body and capable of improving the transfer ratio from the transfer body to a recording medium to thereby insure high image quality.

It is a second object of the present invention to provide an image forming apparatus of the type using a developing liquid and including an intermediate transfer body and capable of cleaning the transfer body and removing a carrier liquid with a simple configuration.

In accordance with the present invention, an image forming apparatus includes a developing device for developing an electrostatic latent image formed on an image carrier with a developing liquid deposited on a developer carrier to thereby produce a corresponding toner image. The toner image is transferred from the image carrier to an intermediate transfer member. A charge applying device applies to the toner image transferred to the intermediate transfer body a charge identical in polarity with toner particles forming the toner image.

Also, in accordance with the present invention, an image forming apparatus includes a developing device for developing an electrostatic latent image formed on an image carrier with a developing liquid consisting of a carrier and charged toner particles to thereby produce a corresponding toner image. The toner image is transferred from the image carrier to an intermediate transfer body. A roller member faces the surface of the intermediate transfer body on which the toner image is transferred.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
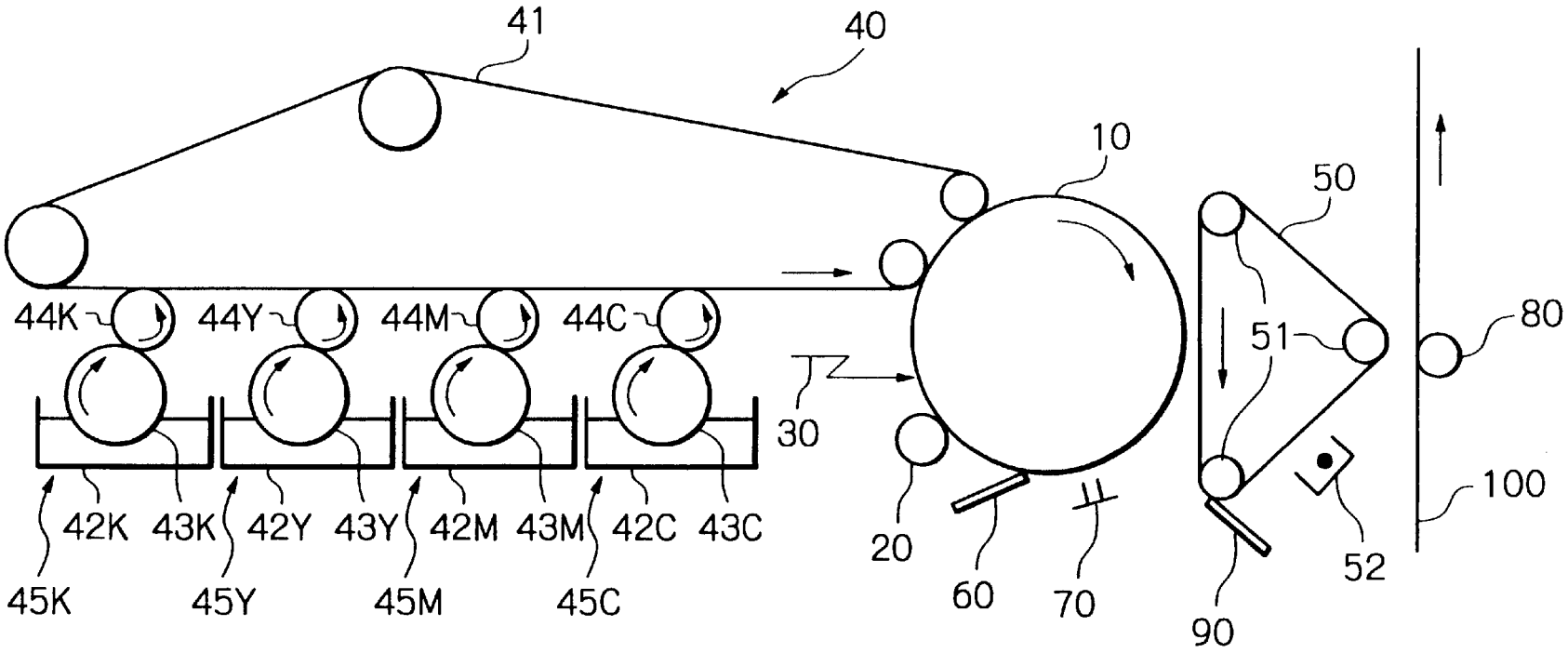
FIG. 1 is a view showing a specific configuration of an image forming apparatus embodying the present invention.

Referring to FIG. 1 of the drawings, an image forming apparatus embodying the preset invention is shown and applied to a color electrophotographic copier by way of example. This embodiment is directed toward the first object stated earlier. As shown, the copier includes a photoconductive element implemented as a drum 10. Arranged around the drum 10 are a charge roller or charger 20, an exposing device 30, a cleaning unit 60 including a cleaning blade, a discharge lamp or discharger 70, a developing device 40, and an endless intermediate transfer belt (simply transfer belt hereinafter) 50 playing the role of an intermediate transfer body.

The transfer belt 50 is passed over a plurality of rollers 51 and driven by a motor or similar drive means, not shown, in the direction indicated by an arrow in FIG. 1. One of the rollers 51 serves as a bias roller for applying a bias for image transfer to the transfer belt 50. A power supply, not shown, applies a preselected voltage for image transfer to the above roller. A cleaning unit 90 for cleaning the transfer belt 50 includes a cleaning blade. A transfer roller or transferring means 80 faces the transfer belt 50 and transfers a toner image from the transfer belt 50 to a paper or similar recording medium 100. A power supply, not shown, applies a bias for image transfer to the transfer roller 80. A corona charger or charge applying means 52 adjoins the transfer belt 50.

The developing device 40 includes a developer carrier implemented as an endless developing belt 41. A Bk (black) developing unit 45K, a Y (yellow) developing unit 45Y, an M (magenta) developing unit 45M and a C (cyan) developing unit 45C are arranged side by side in the vicinity of the developing belt 41. The developing belt 41 is passed over a plurality of rollers and driven by a motor or similar drive means, not shown, in the direction indicated by an arrow in FIG. 1. At a position where the developing belt 41 contacts the drum 10, the former moves at substantially the same speed as the latter.

The Bk, Y, M and C developing units 45K–45C are identical in configuration with each other. The following description will concentrate on the Bk developing unit 45K by way of example. The other developing units 45Y, 45M and 45C are simply distinguished from the developing unit 45K by suffixes Y, M and C attached to the reference numerals.

The Bk developing unit 45K includes a tank 42K storing a viscous, dense developing liquid consisting of toner particles and a carrier liquid. A scoop roller 43K has its lower portion immersed in the developing liquid stored in the tank 42K. A conductive applicator roller 44K applies the developing liquid scooped up by the roller 43K to the developing belt 41 in the form of a thin layer. A power supply, not shown, applies a preselected bias to the applying roller 44K.

Figure 2:
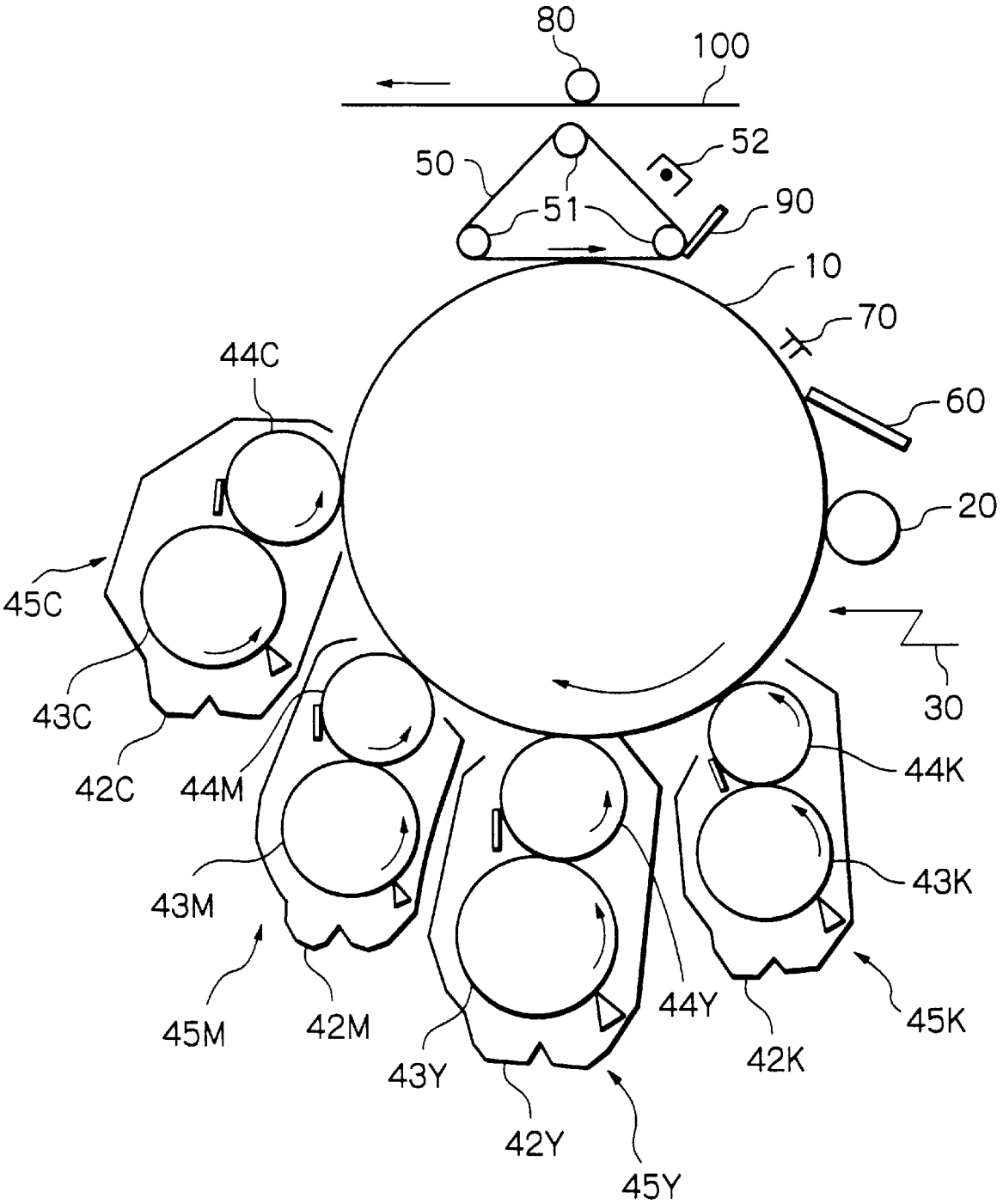
FIG. 2 is a view showing another specific configuration of the illustrative embodiment.

If desired, the developing units 45K–45C may be sequentially arranged around the drum 10, as shown in FIG. 2.

In operation, while the drum 10 shown in FIG. 1 is rotated in the direction indicated by the arrow, the charge roller 20 uniformly charges the surface of the drum 10. Optics, not shown, included in the exposing device 30 focuses an imagewise reflection from a document, not shown, on the charged surface of the drum 10. As a result, a latent image is electrostatically formed on the drum 10. The developing device 40 develops the latent image to thereby produce a corresponding toner image. Specifically, the developing liquid forming a thin layer on the developing belt 41 is transferred form the belt 41 to the drum 10 at the position where the belt 41 and drum 10 contact each other.

The toner image is transferred from the drum 10 to the transfer belt 50 at a position where the drum 10 and belt 50 contact and move at the same speed as each other. Let the image transfer from the drum 10 to the transfer belt 50 be referred to as primary transfer hereinafter. In this sense, the above position where the drum 10 and developing belt 50 contact each other will be referred to as a primary transfer position. To form a three-color or four color image, i.e., a color image on the transfer belt 50, the above procedure is repeated color by color.

The corona charger 52 applies a charge to the color toner image formed on the transfer belt 50. Specifically the corona charger 52 is positioned downstream of the position where the drum 10 and developing belt 50 contact each other in the direction of rotation of the belt 50, but upstream of the position where the belt 50 and paper 100 contact each other. The corona charger 52 applies to the toner image a true charge of the same polarity as the charge of the toner particles forming the toner image. The charge is sufficient for the toner image to be desirably transferred from the developing belt 50 to the paper 100.

The color toner image charged by the corona charger 52 is collectively transferred from the developing belt 50 to the paper 100 by the transfer bias of the transfer roller 80. This image transfer will be referred to as secondary transfer. The paper 100 is fed from a paper feed section not shown. The paper 100 with the toner image is separated from the developing belt 50 by a device, not shown, and conveyed to a fixing unit not shown. After the toner image has been fixed on the paper by the fixing unit, it is driven out of the copier. The cleaning unit 60 removes the toner left on the drum 10 after the primary transfer, and then the discharge lamp 70 discharges the drum 10 to prepare it for the next charging.

Development and image transfer were effected with the illustrative embodiment by using a developing liquid having a solid matter content of 15% and a transfer belt having a volume resistivity of about 10Ω·cm. The amount of charge to be deposited on the transfer belt 50 by the corona charger 52 was varied. First, at the time of the primary transfer, the developing liquid transferred from the drum 10 to the developing belt 50 had a solid matter content of about 25% for a single-color image or a solid matter content of about 30% to 40% for a four-color image. This indicates that the toner gathered more density on the transfer belt in the case of the four-color copy than in the case of the single-color copy. The volume resistivity of the transfer belt 50 should range from several Ω·cm to $10^8$Ω·cm inclusive, preferably from several Ω·cm to $10^3$Ω·cm.

Figure 3:
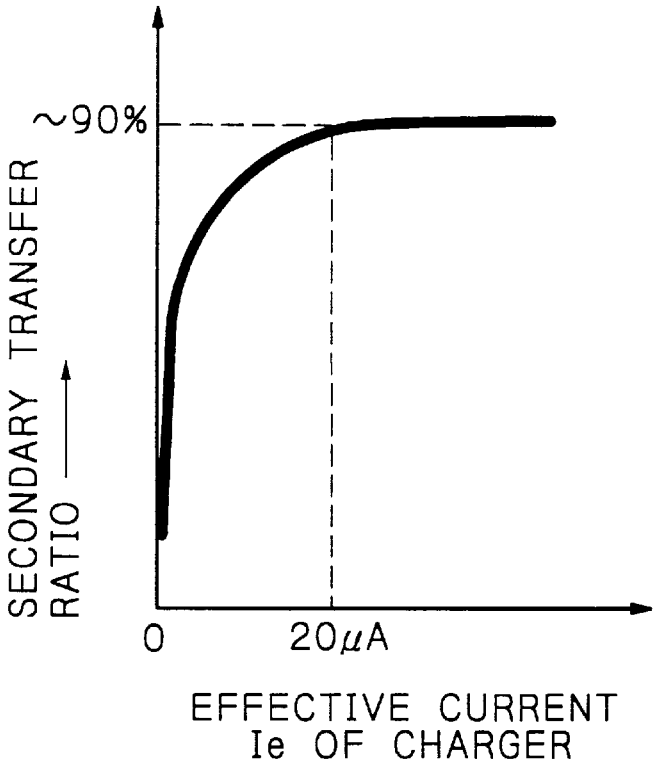
FIG. 3 is a graph showing a relation between the effective current of charge applying means and the secondary transfer ratio.
Figure 4:
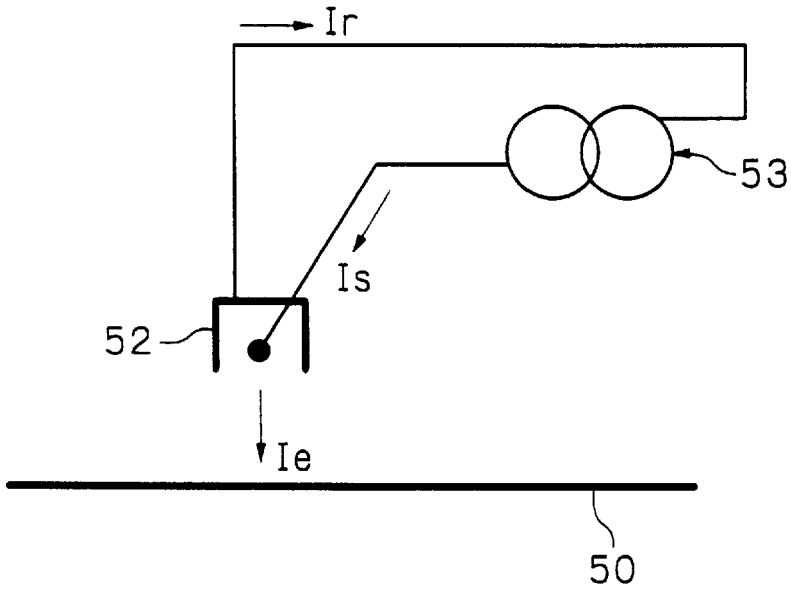
FIG. 4 is a view for describing the effective current.

FIG. 3 shows a curve representative of the results of secondary transfer of four-color images. In FIG. 3, the ordinate and abscissa indicate a secondary transfer ratio and an effective current, respectively. As shown in FIG. 4, the effective current refers to an effective current value Ie applied from the corona charger 52 to a toner image formed on the transfer belt 50. Assume that a current output from a power supply 53 is is, and that a current input to the casing of the corona charger 52 is Ir. Then, the above effective current Ie is expressed as:

$$Ie=Is-Ir$$

The current Is output from the power source 53 is so controlled as to maintain the effective current Ie constant.

As shown in FIG. 3, when the effective current was 0 $\mu$A, i.e., when the corona charger 52 did not apply any charge to a four-color toner image, the secondary transfer ratio was as low as about 12%. The transfer ratio noticeably increased when the effective current was increased up to 20 $\mu$A. This proves the effect achievable with the charge applied by the corona charger 52.

When the effective current was increased above 20 $\mu$A, the secondary transfer ratio increased little. The effective current of 20 $\mu$A is therefore a saturation current. Assuming that 20 $\mu$A is the minimum necessary current for increasing the secondary transfer ratio, then an amount of charge required for a unit mass of the developer is $2.4\times10^{-3}$ C/g.

As stated above, in the illustrative embodiment, the corona charger 52 applies a true charge of the same polarity as the charge of the toner particles forming a toner image on the transfer belt 50 to the toner image. With this charge, it is possible to increase the secondary transfer ratio.

Other specific configurations of the charge applying means and capable of being substituted for the corona charger 52 will be described hereinafter.

Figure 5:
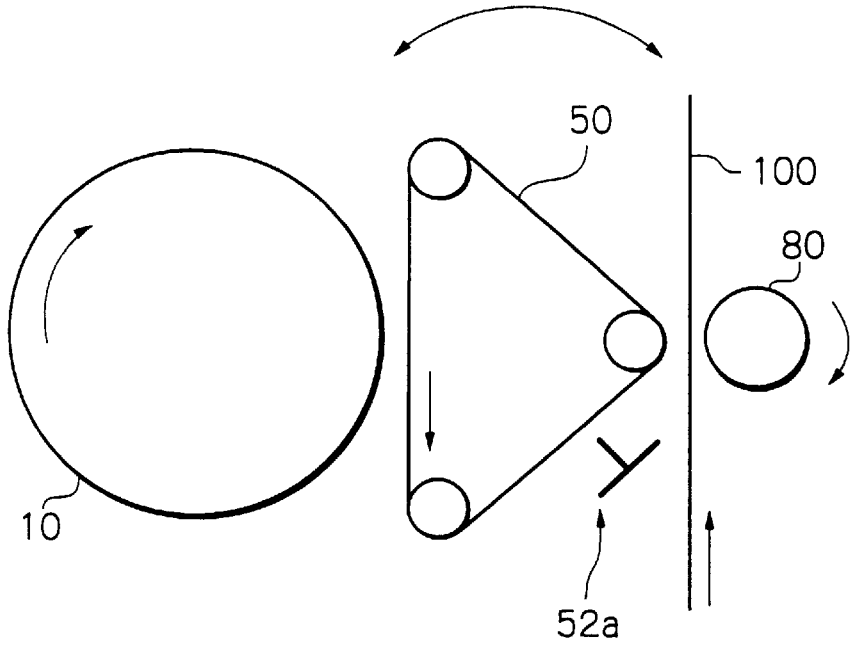
FIG. 5 is a view showing a specific configuration of the charge applying means.
Figure 6:
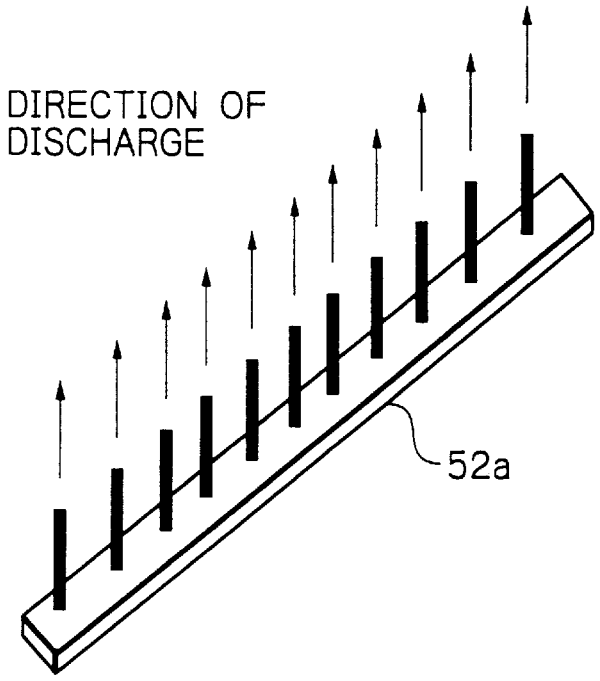
FIG. 6 is a fragmentary view of the charge applying means shown in FIG. 5.

FIGS. 5 and 6 show a charger 52*a* implemented by thin wire-like conductors extending perpendicularly to the toner image support surface of the transfer belt 50. The charger 52*a* discharges from the tips of the thin conductors toward a toner image and thereby deposits a true charge sufficient for desirable secondary transfer. That is, the toner is easily transferred from the transfer belt 50 to the paper 100, increasing the secondary transfer ratio. In addition, the charger 52*a* is lower in cost than the other chargers and therefore reduces the cost of the copier.

Figure 7:
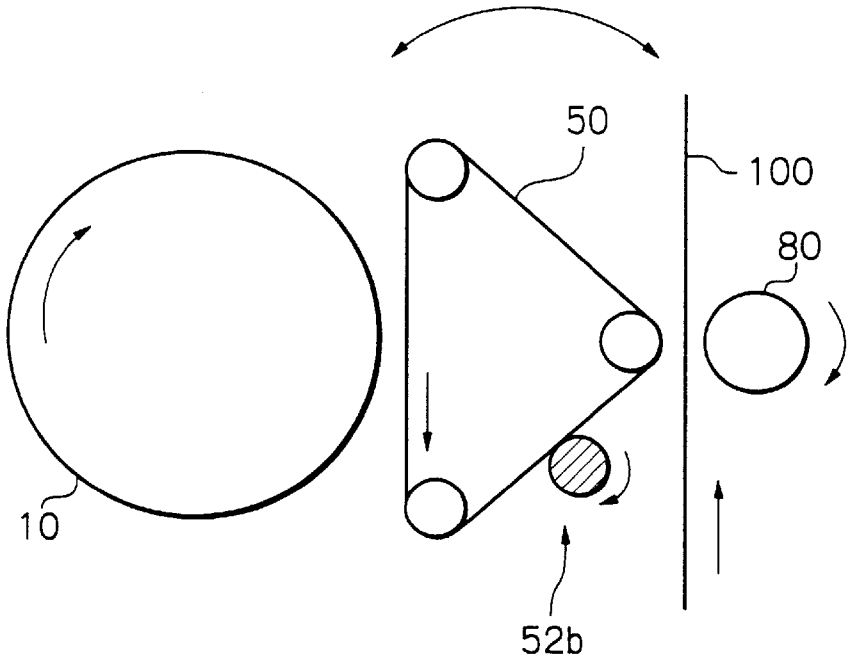
FIG. 7 is a view showing another specific configuration of the charge applying means.

FIG. 7 shows a rotatable charge roller 52*b* also playing the role of the charge applying means and held in contact with the transfer belt 50. The charge roller 52*b* is capable of applying a true charge uniformly to the entire toner image formed on the transfer belt 50. This is also successful to promote the transfer of the toner and therefore to increase the secondary transfer ratio. In addition, the charge roller 52*b* is desirable from the ozone reduction and power saving standpoint.

Figure 8:
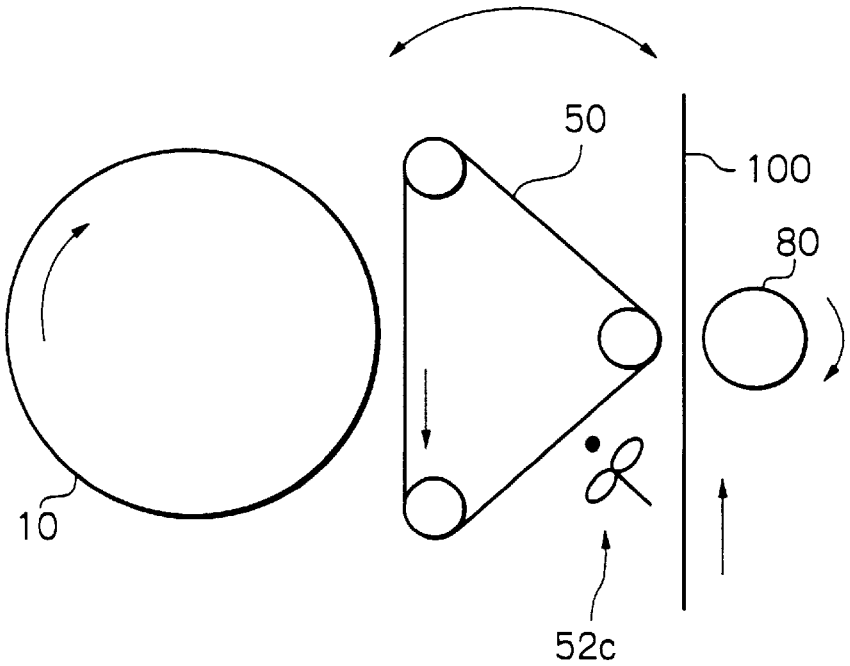
FIG. 8 is a view showing still another specific configuration of the charge applying means.

Further, FIG. 8 shows an ion-flow charger 52*c* capable of applying a true charge sufficient for desirable toner transfer without contacting the transfer belt 50. The ion-flow charger 52*c* can therefore increase the secondary transfer ratio without undesirably effecting a toner image. In addition, with the charger 52*c*, it is possible to easily adjust the amount of corona ions.

The charge applying means having any one of the above specific configurations is located downstream of the primary transfer position in the direction of rotation of the intermediate transfer body, but upstream of the secondary transfer position, as stated earlier. The charge applying means can therefore reduce the time interval between the end of the primary transfer and the beginning of the secondary transfer, compared to the case wherein it is located upstream of the primary transfer position, but downstream of the secondary transfer position. Specifically, the charge applying means located at the former position charges a toner image transferred to the intermediate transfer body by the primary transfer before the toner image reaches the secondary transfer position, so that the secondary transfer can be effected immediately. By contrast, when the charge applying means is located at the latter position, the toner image must be conveyed past the secondary transfer position once, then charged by the charge applying means, and again brought to the secondary transfer position. This delays the secondary transfer by a period of time necessary for the intermediate transfer body to make one rotation.

As for the developing liquid, the transfer ratio decreases when the solid matter content is higher than 5% inclusive. The above embodiment uses a developing liquid having a solid matter content of 15% in order to facilitate handling. In practice, the amount of charge noticeably decreases due to the dense gathering of the toner on the transfer belt 50 in the range of from 5% to 70%, preferably from 10% to 30%. In this sense, the charge applied to a toner image, as stated above, is particularly effective and further increases the secondary transfer ratio.

In the illustrative embodiment, the transfer belt 50 has a resistance low enough to prevent the surface of the belt 50 from being charged and to allow a minimum of charge deposited by the charge applying means to remain on the belt 50. This is successful to free the secondary transfer from irregularity and to promote easy bias application for the secondary transfer. While the above embodiment has concentrated on the endless transfer belt 50, the present invention is practicable with any other suitable intermediate transfer body, e.g., a roller.

The following various advantages are achievable with the illustrative embodiment.

(1) The charge applying means applies a charge sufficient for desirable image transfer to a toner image formed on the intermediate transfer body. Such a charge successfully increases the secondary transfer ratio and thereby insures high quality images.

(2) When the charge applying means is implemented by a traditional corona charger, it can be easily arranged in the image forming apparatus.

(3) The charge applying means in the form of thin wire-like conductors is lower in cost than the other charge applying means and therefore reduces the overall cost of the apparatus.

(4) The charge applying means in the form of a charge roller contacting the intermediate transfer body reduces ozone and saves power.

(5) The charge applying means in the form of an ion-flow charger is capable of charging a toner image formed on the intermediate transfer body without contacting the transfer body. This protects the toner image from disturbance and allows the amount of corona ions to be easily adjusted.

(6) The developing liquid has a solid matter content as high as 5% to 70%. In this sense, the charge applied by the charge applying means is particularly effective, i.e., further enhances the secondary transfer ratio and improves image quality.

(7) The intermediate transfer body has a volume resistivity ranging from several $\Omega\cdot$cm to $10^8\Omega\cdot$cm, preferably from several $\Omega\cdot$cm to $10^3\Omega\cdot$cm. This prevents the transfer body itself from being charged and allows a minimum of charge applied by the charge applying means to remain on the transfer body for thereby obviating irregular secondary transfer. Further, the transfer bias for the secondary transfer can be easily applied.

(8) The charge applying means is positioned downstream of the primary transfer position in the direction of rotation of the intermediate transfer body, but upstream of the secondary transfer position. This reduces the time interval between the end of the primary transfer and the beginning of the secondary transfer, compared to the case wherein the charge applying member is located upstream of the primary transfer position, but downstream of the secondary transfer position.

Figure 9:
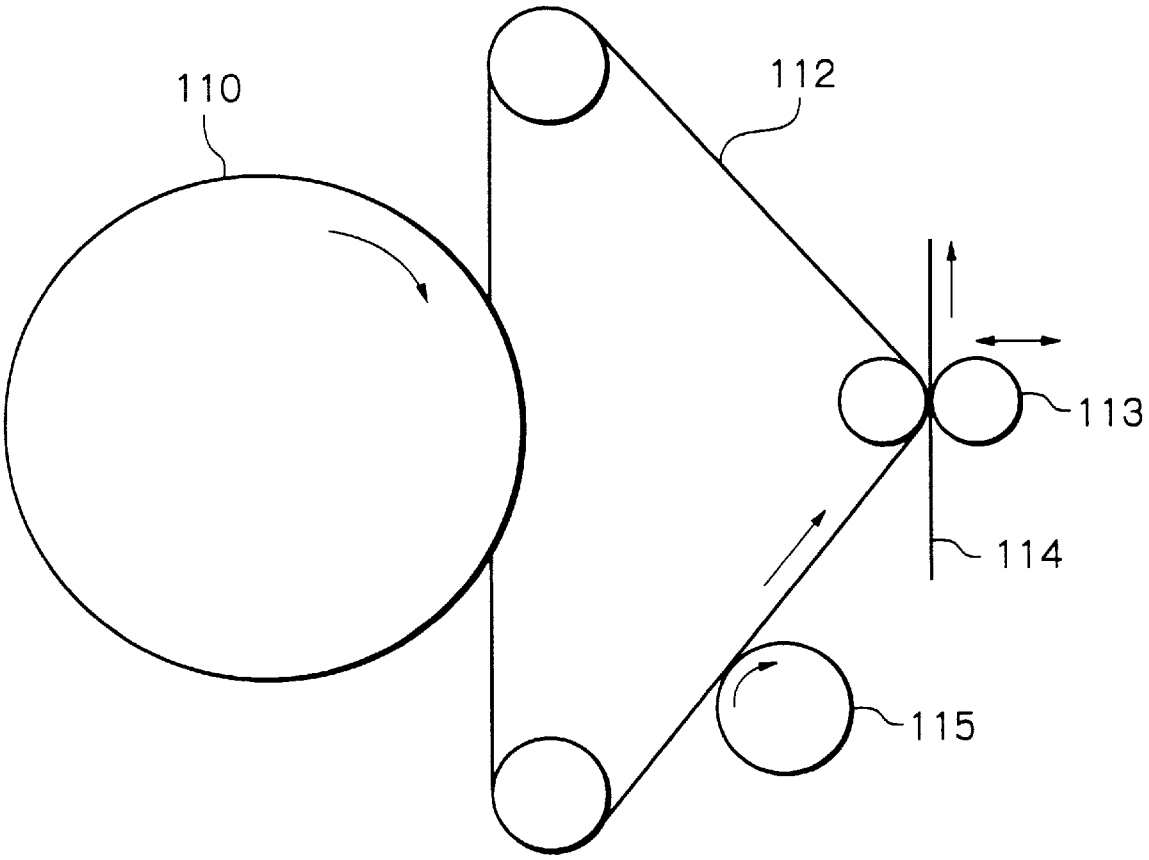
FIG. 9 is a fragmentary view showing an alternative embodiment of the present invention.

Reference will be made to FIG. 9 for describing an alternative embodiment of the present invention. The alternative embodiment is also implemented as a color electrophotographic copier and constructed to achieve the second object stated earlier. As shown, the copier includes a photoconductive drum or image carrier 110. A motor or similar drive means, not shown, causes the drum 110 to rotate at a constant speed in the direction indicated by an arrow during copying operation. A charger, not shown, uniformly charges the surface of the drum 110 in the dark. An optical writing device, not shown, scans the charged surface of the drum 110 with a beam in accordance with image data, thereby forming a latent image on the drum 110. The image data is single-color image data output by separating a desired full-color image into yellow, magenta, cyan and black color components.

A developing device, not shown, develops each of latent images sequentially formed on the drum 110 with particular one of yellow, magenta, cyan and black developing liquids. The resulting yellow, magenta, cyan and black toner images sequentially formed on the drum 110 are transferred to a transfer belt 112 one above the other (primary transfer), forming a full-color image. The transfer belt or intermediate transfer body 112 is driven at the same speed as the drum 110. The full-color image is collectively transferred from the transfer belt 112 to a paper 114 by a transfer roller 113 (secondary transfer). The paper 114 is fed from a paper feed section not shown. After the secondary transfer, the full-color image on the paper 114 is fixed by a fixing unit not shown.

The toner left on the drum 110 after the primary transfer is removed by a cleaning device not shown. Subsequently, a discharge lamp, not shown, discharges the surface of the drum 110 to prepare it for the next copying operation. On the other hand, the toner and carrier liquid left on the transfer belt 112 after the secondary transfer are removed by a roller 115.

The transfer belt 112 shown in FIG. 9 is a specific form of the intermediate transfer body and may be replaced with, e.g., a rigid roller covered with rubber or similar elastic material (e.g. blanket customary with a printer). The transfer belt 112 may be implemented as a seamless elastic belt having metallic wires or threads sandwiched between elastic layers. Further, use is of a material not swelling with the developing liquid or an overcoat.

Figure 10:
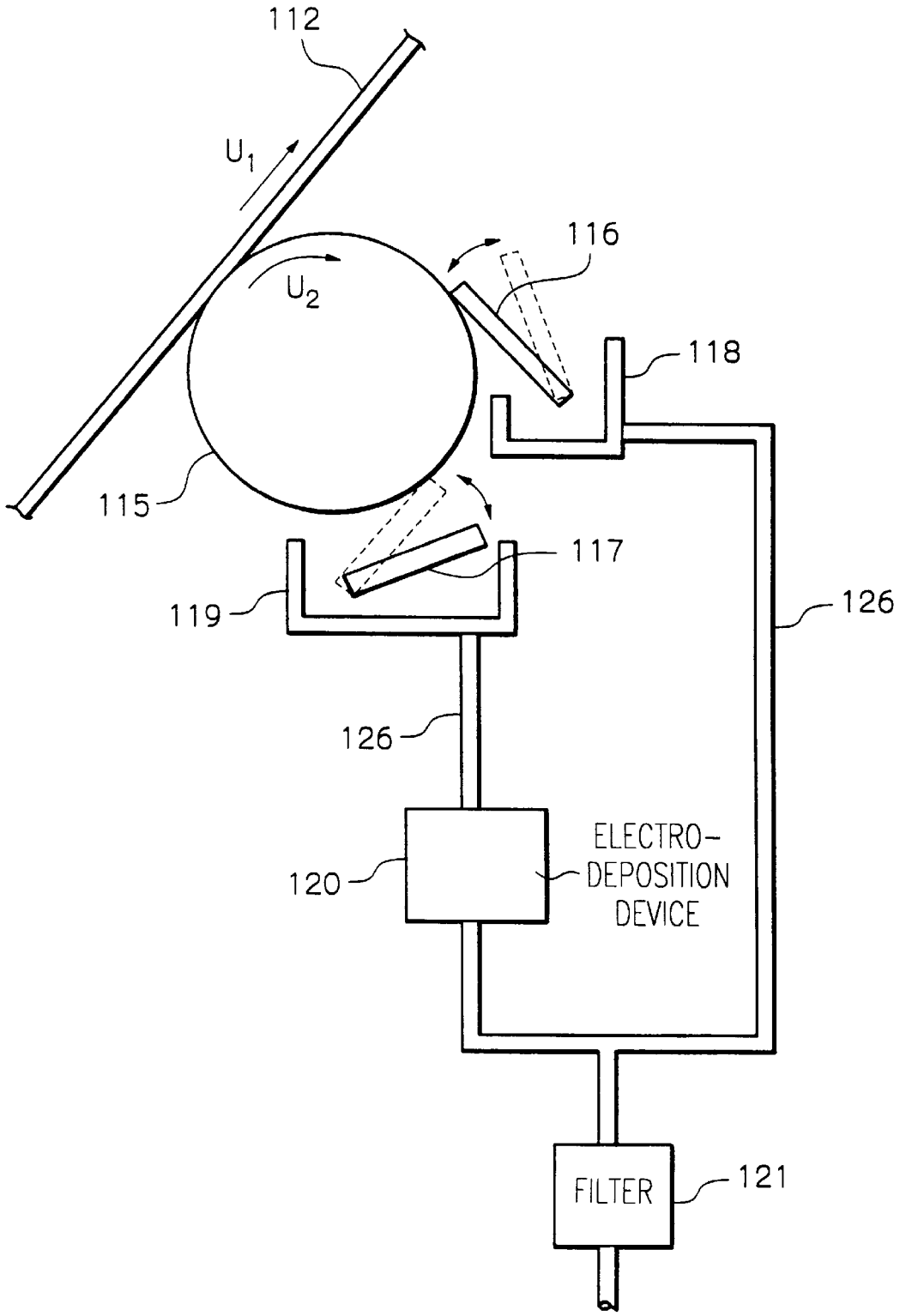
FIG. 10 is a view showing an intermediate transfer body and a roller included in the embodiment of FIG. 9 together with arrangements surrounding them.

FIG. 10 shows the transfer belt 112, roller 115 and arrangements surrounding them which characterize this embodiment. The roller 115 is held in contact with the transfer belt 112 which moves at a preselected speed U1. A variable speed motor or similar drive means, not shown, causes the roller 115 to rotate at a speed U2 in the direction indicated by an arrow. The roller 115 should preferably be formed of rubber or metal having a medium volume resistivity ranging from $10^5\Omega\cdot$cm to $10^{10}\Omega\cdot$cm. When the roller 115 is formed of metal and if the volume resistivity of the transfer belt 112 is lower than $10^4\Omega\cdot$cm, an electric insulating layer should preferably be provided on the surface of the roller 115.

To clean the surface of the roller 115, a first blade 116 and a second blade 117 are respectively positioned relatively upstream and relatively downstream of the position where the transfer belt 112 and roller 115 contact in the direction of movement of the surface of the roller 115. The two blades 116 and 117 each clean the surface of the roller 115 by scraping it, and each is formed of rubber by way of example. The blades 116 and 117 each are movable into and out of contact with the roller 115 by being driven by a respective solenoid or similar drive means.

A first tank 118 is positioned beneath the first blade 116 for collecting the developing liquid scraped off from the roller 115 by the blade 116. Likewise, a second tank 119 is positioned beneath the second blade 117. An electrodeposition device 120 removes toner and other solids from the liquid collected in the second tank 119. A filter 121 removes paper dust and other impurities from the liquid fed from the first tank 121 and electrodeposition device 120.

Figure 11:
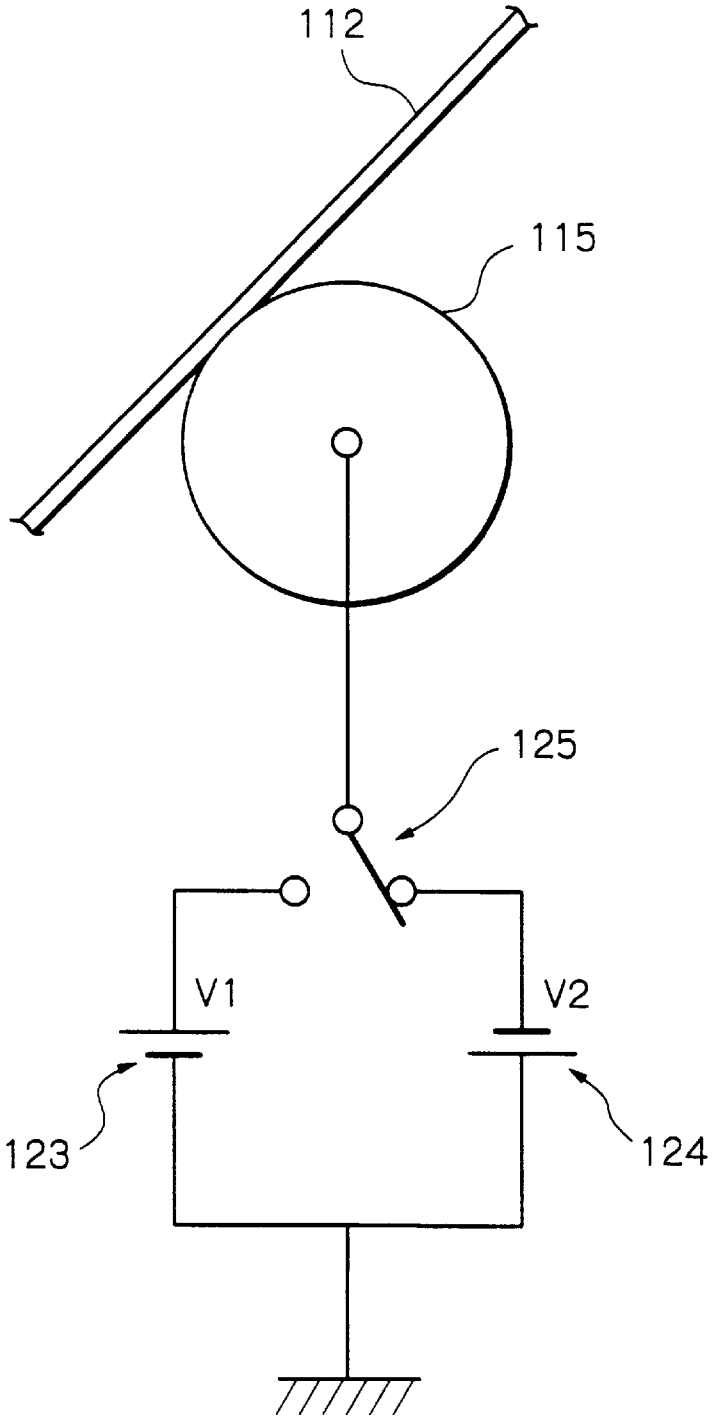
FIG. 11 is a view showing the electrical arrangement of the intermediate transfer body and roller of FIG. 10.

FIG. 11 shows the electrical arrangement of the transfer belt 112 and roller 115. As shown, a positive and a negative bias voltage are selectively applied to the roller 115. Specifically, a DC bias voltage source 123 applies a preselected positive bias voltage V1 to the roller 115 while a DC bias voltage source 124 applies a preselected negative voltage V2 to the roller 115. A switch 125 connects either one of the bias voltage sources 123 and 124 to the roller 115 under the control of, e.g., a main controller not shown.

Assume that the polarity of the toner is positive and that the potential on the surface of the transfer belt 112 is negative. Then, to remove the excess carrier liquid from the transfer belt 112, it is necessary to satisfy a relation of $V2<V0$ where V0 is the surface potential of the belt 112. Conversely, if the surface potential of the transfer belt 112 is positive, then a relation of $V1>V0$ should be satisfied.

The operation of the illustrative embodiment will be described on the assumption that the polarity of the toner is positive. The operation is generally made up of a procedure for removing the carrier liquid from the transfer belt 112 at the time of the primary transfer and secondary transfer and a procedure for cleaning the belt 112 after the secondary transfer.

First, to remove the carrier liquid at the time of the primary transfer and secondary transfer, the roller 115 is driven by the surface of the transfer belt 112 or by a drive source not shown. The positive bias voltage V1 is applied to the roller 115. The first blade 116 is brought into contact with the roller 115. In this condition, the bias voltage V1 generates a force pressing the toner image carried on the transfer belt 112 against the belt 112, so that the solid toner does not deposit on the roller 115. On the other hand, the carrier liquid deposited on the non-image portion of the belt 112 and a part of the excess carrier liquid deposited on the image portion deposit on the roller 115 due to a mechanical or a hydrodynamic force. During this procedure, the second blade 117 is spaced from the roller 115.

While the polarity of the toner has been assumed to be positive, the above procedure can be executed even when the polarity is negative only if the bias voltage for the roller 115 is reversed in polarity.

The roller 115 should preferably be driven in the following manner. As the ratio of the speed U2 of the surface of the roller 115 to the speed U1 of the surface of the transfer belt 2, i.e., U2/U1 increases, i.e. as the speed U2 increases relative to the speed U1, the carrier liquid can be removed in a greater amount from the surface of the belt 112. However, should the ratio U2/U1 increase above a certain limit, it would disturb the toner image due to the shearing force of the fluid. In light of this, the roller 115 should preferably be rotated within a range not exceeding the above limit so as to remove the carrier liquid from the surface of the transfer belt 112.

Figure 12:
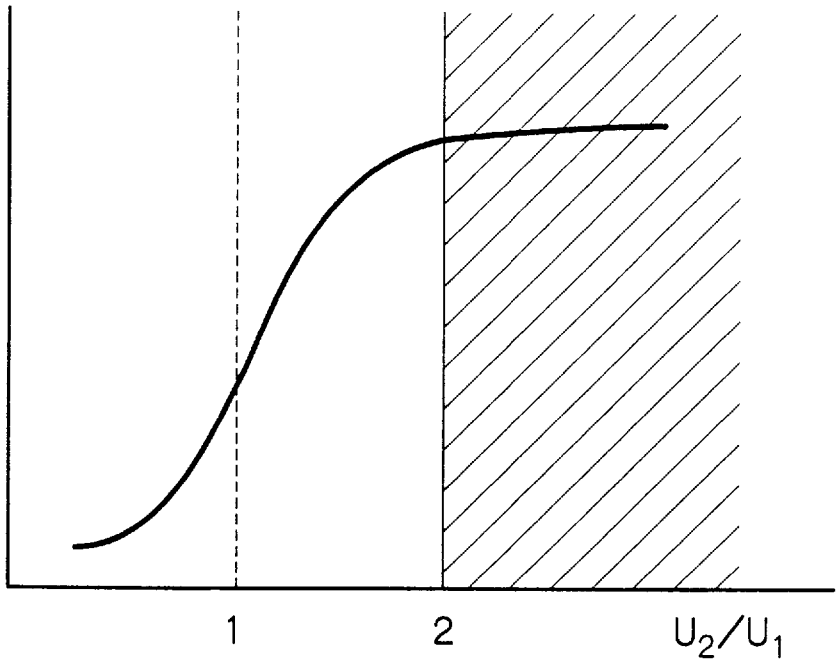
FIG. 12 is a graph showing a relation between the ratio of the moving speed of the surface of the roller to that of the surface of the intermediate transfer member and the amount of a carrier liquid to deposit on the roller.

FIG. 12 is a graph showing a relation between the above ration U2/U1 and the amount of the carrier liquid to deposit on the roller 115. In the illustrative embodiment, the ratio U2/U1 is variable by controlling the rotation speed of the roller 115 while maintaining the speed U1 of the transfer belt 112 constant. The ratio U2/U1 must be controlled in consideration of temperature and other ambient factors.

A specific arrangement for controlling the ratio U2/U1 is as follows. A tachometer is mounted on the output shaft of a motor, not shown, for driving the roller 115. The main controller performs calculation with, e.g., temperature sensed by a temperature sensor and the speed of the motor output from the tachometer, thereby determining an optimal speed of the motor. The optimal motor speed is input to a motor driver, not shown, for controlling the motor speed and therefore the ratio U2/U1.

For example, when temperature inside the copier tends to rise as in summer, the viscosity of the carrier liquid is low and apt to cause the liquid to deposit on the roller 115. In such a condition, the rotation speed of the roller 115 is lowered in order to reduce the ratio U2/U1. Conversely, when temperature inside the apparatus is low, e.g., just after the start of operation of the apparatus in winter, the viscosity of the carrier liquid is high and allows a minimum of carrier liquid to deposit on the roller 115. In this case, the rotation speed of the roller 115 increased to increase the ratio U2/U1. The prerequisite is that the rotation speed of the roller 115 be so controlled as to maintain the ratio U2/U1 below a certain limit for the reason stated earlier. This kind of control is effective to uniform the amount of carrier liquid throughout the primary transfer and secondary transfer in the event of single-color printing and four-color printing.

The carrier liquid removed by the roller 115 from the transfer belt 112 is collected by the first blade 116 contacting the roller 115. The filter 121 filters out paper dust and other impurities from the collected carrier liquid, so that the carrier liquid can be reused for, e.g., the adjustment of the density of the developer as a pure carrier liquid.

The above procedure controls the rotation speed of the roller 115 while maintaining the moving speed U1 of the transfer belt 112 constant. Alternatively, during the interval between the end of the primary transfer and the beginning of the secondary transfer, the ratio U2/U1 may be varied by varying the speed U1 while maintaining the speed U2 constant. This is because the speed U1 does not have to be maintained the same as the speed of the moving speed of the surface of the drum 110 or that of the paper 114 during the above interval. Likewise, during the interval between the end of the primary transfer and the beginning of the secondary transfer, both of the rotation speed of the roller 115 and the movement speed U2 of the belt 112 may be varied to vary the ratio U2/U1.

The surface of the transfer belt 112 is cleaned after the secondary transfer, as follows. Again, the roller 115 is driven by, e.g., the surface of the transfer belt 112 or by the drive source not shown. The polarity of the bias voltage to be applied to the roller 115 is switched from positive to negative. At the same time, the second blade 117 is brought into contact with the roller 115 while the first blade 116 is released from the roller 115. In this condition, a mechanical or a hydrodynamic force acts on the solid toner and carrier liquid left on the transfer belt 112 in such a manner as to cause it to adhere to the roller 115. In addition, an electrostatic force acts on the solid toner in such a manner as to cause it to adhere to the roller 115. The second blade 117 removes the solid toner and carrier liquid deposited on the roller 115. The solid toner and carrier liquid so removed by the blade 17 are temporarily stored in the second tank 119 and then delivered to the electrodeposition device 120 via a passage 126 so as to remove the solid toner. Subsequently, paper dust and other impurities are filtered out by the filter 121. The resulting pure carrier liquid is reused for, e.g., the adjustment of the density of the developer, as state earlier.

Figure 13:
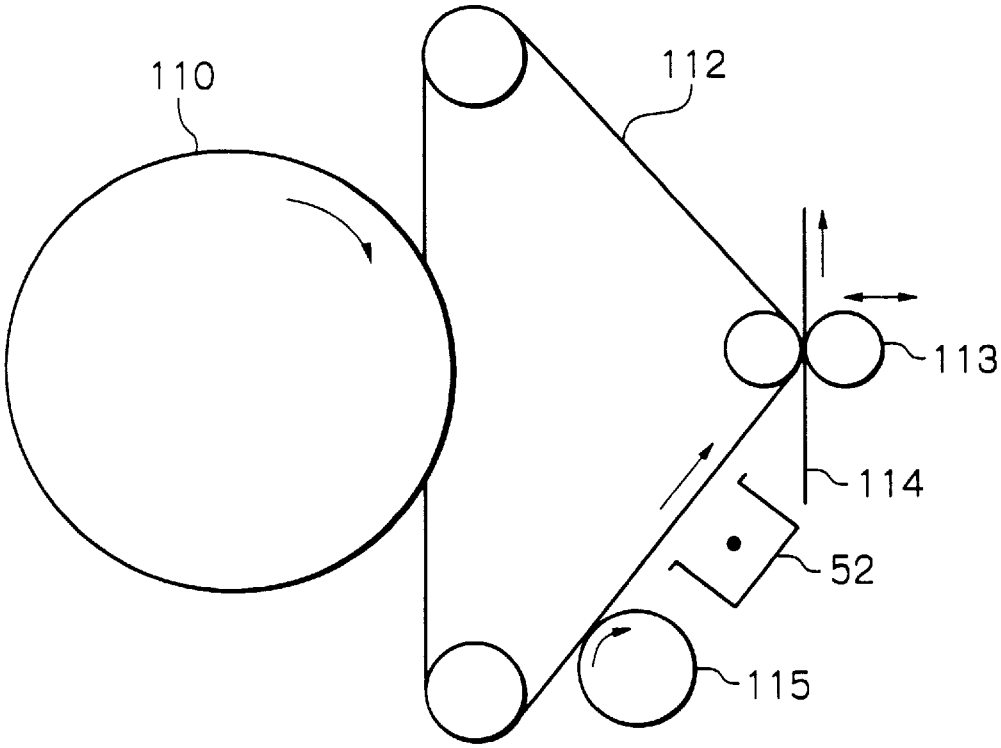
FIG. 13 is a view showing another specific configuration of the embodiment of FIG. 9.

As shown in FIG. 13, the charger 52 of the previous embodiment and having any one of the specific configurations shown and described may be added to the above embodiment.

With the above simple construction, the illustrative embodiment is capable of efficiently cleaning the surface of the transfer belt 112, adjusting the amount of carrier liquid, and reusing the carrier liquid collected from the belt 112.

In summary, the alternative embodiment shown and described has the following various unprecedented advantages.

(1) The roller member faces the surface of the intermediate transfer body on which a toner image is formed. A mechanical or a hydrodynamic force acts between the carrier liquid present on the transfer body and the roller member, causing the carrier liquid and toner to deposit on the roller member. It is therefore possible to remove the excess carrier liquid at the time of the primary transfer and secondary transfer and to clean the transfer body after the secondary transfer.

(2) The voltage applying means selectively applies a voltage of the same polarity as the charge of toner or a voltage opposite in polarity to the same to the roller member. For example, for the primary transfer, a bias voltage of the same polarity as the charge of toner and forming an electric field pressing the toner on the transfer body against the transfer body is applied to the roller member. This allows the roller member to remove only the excess carrier liquid. To clean the transfer body after the secondary transfer, a bias voltage opposite in polarity to the charge of toner and forming an electric field attracting the toner on the transfer body toward the roller member is applied to the roller member. This allows the roller member to remove the toner form the transfer body. In this manner, it is possible to remove the carrier liquid and toner from the transfer body.

(3) At least two cleaning means are assigned to the roller member and selectively brought into contact with the roller member in accordance with the polarity of the voltage applied to the roller member. For example, at the time of the primary transfer, the voltage identical in polarity with the toner is applied to the roller member for removing only the excess carrier liquid. In this case, one of the cleaning means cleans the roller member and collects the excess carrier liquid. To clean the transfer body after the secondary transfer, the voltage opposite in polarity to the toner is applied to the roller member so as to remove the toner and carrier liquid. At this instant, the other cleaning means cleans the roller member for collecting the toner and carrier liquid. In this manner, the excess carrier liquid and the carrier liquid containing toner can be collected independently of each other.

(4) The rotation speed of the roller member is variable to control the collection ratio of the excess carrier liquid on the basis of a mechanical or a hydrodynamic force acting between the carrier liquid on the transfer body and the roller member. When the rotation speed of the roller member is controlled in accordance with the varying ambient conditions including temperature, an optimal amount of carrier liquid can be held on the transfer body.

(5) The filter, for example, filters the excess carrier liquid not containing toner so as to remove dust. On the other hand, the electrodeposition device, for example, removes the solid toner from the carrier containing it. This part of the carrier is then filtered by the filter. In this manner, the collected carrier liquid can be reused after the removal of the solid matter and dust.

Various modifications will become possible for those skilled in the art after receiving the teachings of the present disclosure without departing from the scope thereof.

What is claimed is:

1. An image forming apparatus comprising:

a developing device configured to develop an electrostatic latent image formed on an image carrier with a developing liquid consisting of a carrier and charged toner particles to thereby produce a corresponding toner image;

an intermediate transfer body to which the toner image is transferred from said image carrier; and a roller member facing a surface of said intermediate transfer body on which the toner image is transferred, and configured to control an amount of carrier liquid on said intermediate transfer body.

2. An apparatus as claimed in claim 1, wherein a voltage identical in polarity with the toner and a voltage opposite in polarity to the toner are selectively applied to said roller member.

3. An apparatus as claimed in claim 2, further comprising at least two cleaning means for cleaning a surface of said roller member, and switching means for selecting one of said at least two cleaning means.

4. An apparatus as claimed in claim 3, wherein said switching means selects one of said at least two cleaning means in accordance with the polarity of the voltage to be applied to said roller member.

5. An apparatus as claimed in claim 3, further comprising means for collecting the liquid removed from said roller member by said cleaning means, treating said liquid, and reusing said liquid treated as a carrier liquid of a developer.

6. An apparatus as claimed in claim 1, further comprising variable-speed drive means for driving said roller member.

* * * * *